US009724653B2

(12) United States Patent
Pappalardo

(10) Patent No.: US 9,724,653 B2
(45) Date of Patent: Aug. 8, 2017

(54) DOUBLE WEDGE MIXING BAFFLE AND ASSOCIATED STATIC MIXER AND METHODS OF MIXING

(71) Applicant: Nordson Corporation, Westlake, OH (US)

(72) Inventor: Matthew E. Pappalardo, Ewing, NJ (US)

(73) Assignee: Nordson Corporation, Westlake, OH (US)

( * ) Notice: Subject to any disclaimer, the term of this patent is extended or adjusted under 35 U.S.C. 154(b) by 321 days.

(21) Appl. No.: 14/620,227

(22) Filed: Feb. 12, 2015

(65) Prior Publication Data

US 2016/0236161 A1 Aug. 18, 2016

(51) Int. Cl.
*B01F 5/00* (2006.01)
*B01F 5/06* (2006.01)

(52) U.S. Cl.
CPC ..... *B01F 5/0606* (2013.01); *B01F 5/0641* (2013.01); *B01F 5/0617* (2013.01)

(58) Field of Classification Search
CPC ... B01F 5/0606; B01F 5/0617; B01F 5/06411
USPC ..... 366/337
See application file for complete search history.

(56) References Cited

U.S. PATENT DOCUMENTS 3,195,865 A * 7/1965 Harder ..... B01F 5/0641 366/337
3,239,197 A 3/1966 Tollar
5,851,067 A 12/1998 Fleischli et al.
5,944,419 A 8/1999 Streiff
6,773,156 B2 8/2004 Henning
7,322,740 B2 1/2008 Heusser et al.
7,438,464 B2 * 10/2008 Moser ..... B01F 5/0612 366/337
7,985,020 B2 7/2011 Pappalardo
8,083,397 B2 12/2011 Pappalardo
(Continued)

FOREIGN PATENT DOCUMENTS

EP 0815929 A1 1/1998
EP 2614883 A1 7/2013

OTHER PUBLICATIONS

European Application No. 16154924.1: Extended European Search Report dated Jul. 25, 2016, 8 pages.
(Continued)

*Primary Examiner* — Tony G Soohoo
*Assistant Examiner* — Anshu Bhatia
(74) *Attorney, Agent, or Firm* — Baker & Hostetler LLP

(57) ABSTRACT

A static mixer includes a series of mixing elements, at least some of which are a double wedge mixing baffle. The double wedge mixing baffle includes first and second dividing panels oriented transverse to each other, first and second deflecting surfaces projecting from opposite sides of the first dividing panel, and third and fourth deflecting surfaces projecting from opposite sides of the second dividing panel. One or each of the deflecting surfaces includes first and second planar surfaces arranged at different angles relative to the fluid flow. The double wedge arrangement reduces retained waste volume within the mixer while further manipulating the flow characteristics of fluid flow entering and exiting the mixing baffle, to thereby optimize mixing performance.

25 Claims, 7 Drawing Sheets

(56) References Cited

U.S. PATENT DOCUMENTS

| | | | |
|---|---|---|---|
| 2003/0048694 | A1 | 3/2003 | Horner et al. |
| 2013/0182529 | A1 | 7/2013 | Linne |

OTHER PUBLICATIONS

European Application No. 16154924.1: Third Party Observations dated Apr. 18, 2017 (8 pages).

* cited by examiner

DOUBLE WEDGE MIXING BAFFLE AND ASSOCIATED STATIC MIXER AND METHODS OF MIXING

TECHNICAL FIELD

This disclosure generally relates to a fluid dispenser and more particularly, to components of a static mixer and methods of mixing fluid flows.

BACKGROUND

A number of motionless mixer types exist, such as Multiflux, helical and others. These mixer types, for the most part, implement a similar general principle to mix fluids together. In these mixers, fluids are mixed together by dividing and recombining the fluids in an overlapping manner. This action is achieved by forcing the fluid over a series of baffles of alternating geometry. Such division and recombination causes the layers of the fluids being mixed to thin and eventually diffuse past one another, eventually resulting in a generally homogenous mixture of the fluids. This mixing process has proven to be very effective, especially with high viscosity fluids. Static mixers are typically constructed of a series of alternating baffles, of varying geometries, usually consisting of right-handed and left-handed mixing baffles located in a conduit to perform the continuous division and recombination. Such mixers are generally effective in mixing together most of the mass fluid flow, but these mixers are subject to a streaking phenomenon, which has a tendency to leave streaks of completely unmixed fluid in the extruded mixture. The streaking phenomenon often results from streaks of fluid forming along the interior surfaces of the mixer conduit that pass through the mixer essentially unmixed.

There have been attempts made to maintain adequate mixer length while trying to address the streaking phenomenon. For example, the traditional left-handed and right-handed mixing baffles can be combined with baffles causing greater angles of rotation of the flow (180° or 270° baffles) and/or combined with flow inversion baffles, such as the specialized inverter baffles described in U.S. Pat. No. 7,985,020 to Pappalardo and U.S. Pat. No. 6,773,156 to Henning. Each of these latter types of baffles tends to force the fluid from the periphery into the center of the mixing baffles, and vice versa. While such approaches do reduce the size of streaks moving through the static mixer, the mixing is less efficient because more baffles must be placed in the mixer to thoroughly diffuse these streaks, thus increasing the mixer's length. Such an increase in mixer length can be unacceptable in many motionless mixer applications, such as handheld mixer-dispensers. In addition, longer mixers will generally have a higher retained volume, and higher resulting material waste, which is particularly undesirable when dealing with expensive materials, such as in the electronics, dental, and medical fields.

Therefore, it would be desirable to further enhance the mixing elements used with static mixers of this general type, so that the mixer retains less volume when dispensing is finished and so that mixing performance is further optimized at each mixing element.

SUMMARY

In accordance with one embodiment, a mixing baffle is configured to mix a fluid flow. The mixing baffle includes first and second dividing panels and first, second, third and fourth deflecting surfaces. The first dividing panel includes a first side and a second side and defines a leading edge. The first deflecting surface projects from the first side of the first dividing panel so as to occlude at least part of a path for fluid flow along the first side. The second deflecting surface projects from the second side of the first dividing panel so as to occlude at least part of a path for fluid flow along the second side. The second dividing panel is oriented transverse to the first dividing panel, defines a trailing edge, and includes first and second sides. The third deflecting surface projects from the first side of the second dividing panel proximate to the first deflecting surface. The fourth deflecting surface projects from the second side of the second dividing panel proximate to the second deflecting surface. At least one of the deflecting surfaces is defined by a first planar surface and a second planar surface which is oriented at an angle from the first planar surface. This arrangement causes the first and second planar surfaces to be at different angles relative to the fluid flow. In operation, the fluid flow is divided at the leading edge into first and second flow portions, the first flow portion being shifted by the first and fourth deflecting surfaces to the second side of the second dividing panel, while the second flow portion is shifted by the second and third deflecting surfaces to the first side of the second dividing panel.

In one aspect, each of the four deflecting surfaces in the mixing baffle is defined by a first planar surface and a second planar surface oriented at an angle from the first planar surface. This "double wedge" arrangement reduces retained waste volume within the mixer while further manipulating the flow characteristics of fluid flow entering and exiting the mixing baffle, to thereby optimize mixing performance. In another aspect, the first and second dividing panels each include first and second hook sections bent in opposite directions at the corresponding leading edge and trailing edge. The first and second hook sections further guide flow entering and exiting the mixing baffle.

In various embodiments, each of the second planar surfaces is angled from an adjacent one of the first planar surfaces by an angle ranging between 25° and 50°. Each of the first planar surfaces is angled from a plane perpendicular to the fluid flow by a non-zero angle such that each of the first, second, third and fourth deflecting surfaces defines a double wedge shape. More specifically, each of the first planar surfaces is angled from a plane perpendicular to the fluid flow by an angle between 5° and 15°. Furthermore, in some embodiments, the first planar surfaces of the first and second deflecting surfaces are angled from the plane perpendicular to the fluid flow by a larger angle than the first planar surfaces of the third and fourth deflecting surfaces, thereby providing distinctive mixing characteristics at the entry and exit adjacent the leading and trailing edges.

In another aspect, the first dividing panel is oriented generally perpendicular to the second dividing panel. For example, when the mixing baffle is inserted into a conduit containing the fluid flow, the first dividing panel is oriented generally vertically while the second dividing panel is oriented generally horizontally. Moreover, the first and fourth deflecting surfaces shift the first flow portion to contract downwardly along the first dividing panel before expanding to the right along the second dividing panel, while the second and third deflecting surfaces shift the second flow portion to contract upwardly along the first dividing panel before expanding to the left along the second dividing panel, thereby effectively shifting the first and second flow portions in a counterclockwise direction. Alternatively, the first and fourth deflecting surfaces shift the first flow portion to contract upwardly along the first dividing panel before expanding to the right along the second dividing panel, while the second and third deflecting surfaces shift the second flow portion to contract downwardly along the first dividing panel before expanding to the left along the second dividing panel, thereby effectively shifting the first and second flow portions in a clockwise direction. These two alternative types of mixing baffles may be referred to as left-handed and right-handed.

The first and second dividing panels and the various deflecting surfaces are integrally formed as a unitary piece. To this end, these elements may be injection molded in some embodiments. Moreover, the mixing baffle is integrally molded as part of a series of baffles in some embodiments, or alternatively connected together in the series following manufacture.

According to another embodiment, a static mixer is configured to mix a fluid flow. The mixer includes a mixer conduit configured to receive the fluid flow, and a mixing component defined by a plurality of mixing elements. The mixing elements include a plurality of mixing baffles, each of which includes first and second dividing panels and first, second, third and fourth deflecting surfaces as described in detail above. Some of the plurality of mixing baffles include left-handed mixing baffles that shift the fluid flow in a counterclockwise direction, while others of the plurality of mixing baffles include right-handed mixing baffles that shift the fluid flow in a clockwise direction. To this end, the plurality of mixing baffles includes an alternating series of left-handed and right-handed mixing baffles. The first dividing panel is oriented generally perpendicular to the second dividing panel in one aspect within the conduit, such that the first dividing panel is vertical while the second dividing panel is horizontal.

In accordance with another embodiment, a method of mixing at least two components of a fluid flow with a static mixer includes introducing the fluid flow having at least two components into an inlet end of the mixer conduit. The fluid flow is forced through a plurality of mixing baffles to produce a mixed fluid flow, at least one of the mixing baffles including first and second dividing panels and first, second, third and fourth deflecting surfaces as described further above. The forcing of the fluid further includes dividing the fluid flow with a leading edge of the first dividing panel into a first flow portion and a second flow portion located along opposing first and second sides of the first dividing panel. The first flow portion is shifted with the first and fourth deflecting surfaces from the first side of the first dividing panel to a second side of the second dividing panel, while the second flow portion is shifted with the second and third deflecting surfaces from the second side of the first dividing panel to a first side of the second dividing panel. The first and second flow portions recombine at a trailing edge of the second dividing panel. The method also includes discharging the mixed fluid flow from an outlet end of the mixer conduit after the fluid flow is forced through the plurality of mixing baffles. As with the previous embodiment, at least one of (if not each of) the deflecting surfaces is defined by first and second planar surfaces oriented at an angle relative to one another to shorten the distance that the first or second flow portion needs to travel during shifting along the corresponding deflecting surface.

In one aspect, the fluid flow includes a plurality of alternating layers of the at least two components, such that the method also includes doubling a number of the alternating layers of the at least two components between the leading and trailing edges of each of the mixing baffles. Each of the first and second planar surfaces are angled at a non-zero angle relative to a plane perpendicular to the fluid flow through the static mixer in another aspect. The double wedge shape of the deflecting surfaces in these embodiments is configured to minimize fluid flow waste defined by retained volume within the static mixer when the static mixer is disconnected at the inlet end from a source of the fluid flow when discharging of the mixed fluid flow is completed. In another aspect, the fluid flow characteristics are optimized by shifting flow differently adjacent entry at the first dividing panel as compared to adjacent exit at the second dividing panel, this difference in flow shifting caused by having the first planar surface of the first and second deflecting surfaces be arranged at a different angle relative to the fluid flow than the first planar surface of the third and fourth deflecting surfaces.

These and other objects and advantages of the disclosed apparatus will become more readily apparent during the following detailed description taken in conjunction with the drawings herein.

DETAILED DESCRIPTION

Figure 1:
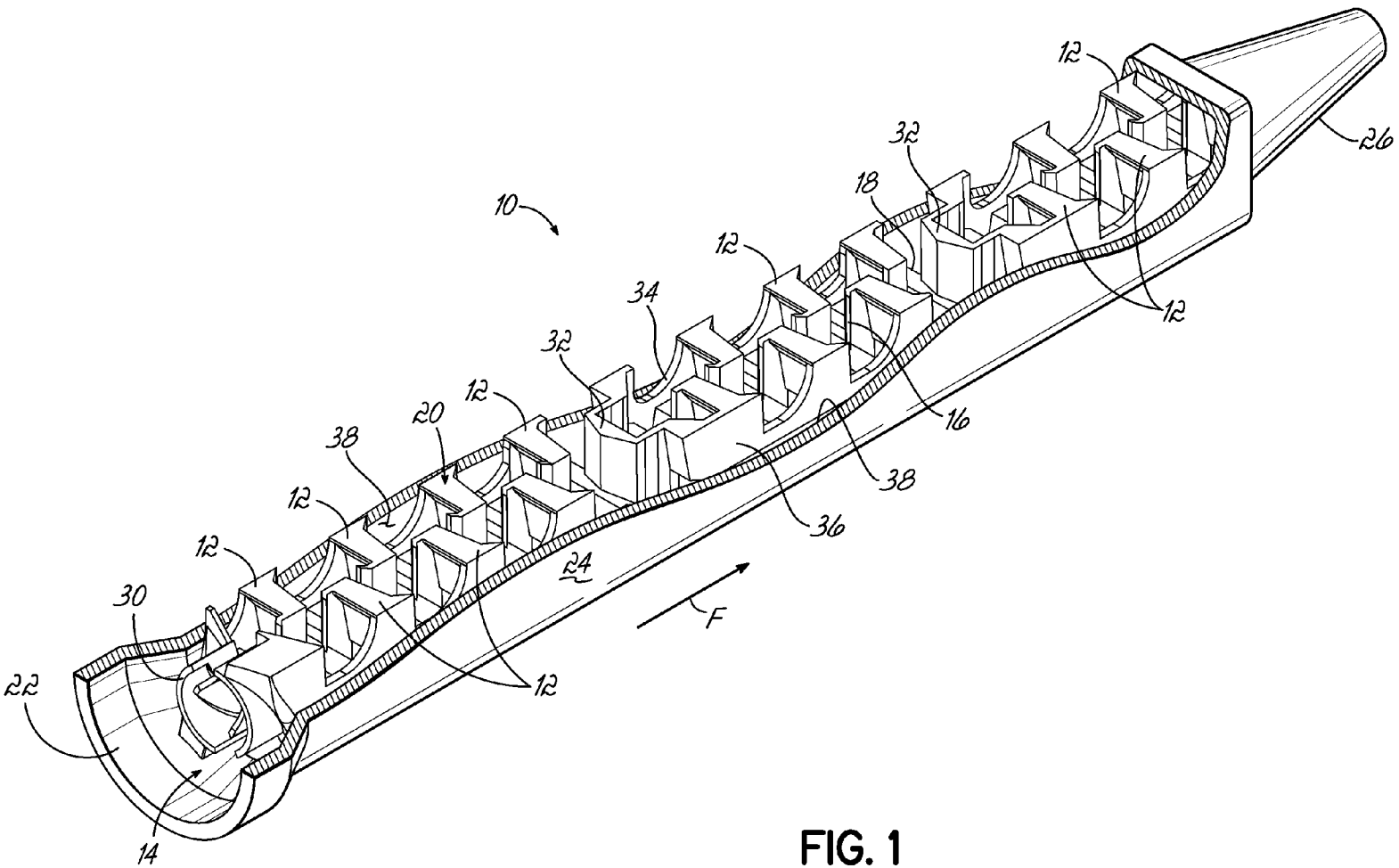
FIG. 1 is a perspective view of a static mixer with a portion of the mixer sidewall removed so as to reveal a mixing component including multiple double wedge mixing baffles in accordance with one embodiment of the invention.

FIG. 1 illustrates one embodiment of a static mixer 10 including a series of mixing baffles 12 in accordance with the principles of the current disclosure. The mixing baffles 12 of this embodiment are also referred to as "double wedge" mixing baffles as a result of the various flow occluding surfaces described in further detail below. Each of the double wedge mixing baffles 12 divides a fluid flow through a conduit 14 at a leading edge 16 of the mixing baffle 12 and then shifts or rotates that flow clockwise or counterclockwise through a partial rotation before recombining the fluid flow at a trailing edge 18 of the mixing baffle 12. Similar to known Multiflux mixing elements, the double wedge mixing baffles 12 include a plurality of deflecting surfaces, which are numbered below with reference to other FIGS., and which force a partial portion of the fluid flow (e.g., one half of the fluid flow) to move through a contracted space (e.g., a quarter of the overall cross-section of the conduit 14 in the illustrated embodiment) before expanding once again towards the trailing edge 18.

However, the double wedge mixing baffles 12 of this embodiment each define a double wedge shape such that the angle of incidence relative to the flow moving through the conduit 14 sharpens or increases adjacent the leading edge 16 and trailing edge 18. This sharpening of the angle of incidence on the angled deflecting surfaces forces fluid flowing through the mixing baffle 12 to contract and then expand more quickly or easily near a dividing point at the leading edge 16 and near a recombination point at the trailing edge 18. To this end, the fluid flowing around the double wedge mixing baffles 12 exhibits better mix quality between two or more fluids moving in the fluid flow than known mixing elements used in static mixers, without significantly adding to the backpressure generated by moving the fluid flow through the static mixer 10. Furthermore, the double wedge mixing baffles 12 fill up more space within the conduit 14 compared to known mixing elements and therefore advantageously reduce a retained volume of fluid when the mixer 10 stops being used, which reduces the material waste at the end of a mixing operation.

Returning with reference to FIG. 1, the static mixer 10 generally includes the conduit 14 and a mixing component 20 inserted into the conduit 14. The conduit 14 defines an inlet end socket 22 configured to be attached to a cartridge, cartridge system, or metering system (none of which are shown) containing at least two fluids to be mixed together. For example, the inlet end socket 22 may be connected to any of the two-component cartridge systems available from Nordson Corporation. The conduit 14 also includes a body section 24 shaped to receive the mixing component 20 and a nozzle outlet 26 communicating with the body section 24. Although the body section 24 and mixing component 20 are shown as having substantially square cross-sectional profiles, those skilled in the art will appreciate that the concepts described below may equally apply to mixers with other geometries, including round or cylindrical as well as others.

The mixing component 20 contained within the static mixer 10 of the embodiment shown in FIG. 1 includes a series of mixing elements and/or baffles. This series of mixing elements and/or baffles begins with an entry mixing element 30 adjacent to the inlet end socket 22 and which is configured to ensure some initial division and mixing of the at least two fluids received in the static mixer 10 (regardless of the orientation of the mixing component 20 relative to the incoming fluid flows), and then continues with a series of left-handed and right-handed versions (labeled $\mathbf{12}_L$ and $\mathbf{12}_R$ below) of the double wedge mixing baffle 12, with a flow shifter element 32 interjected after every set of several double wedge mixing baffle 12 in the series. The flow shifter element 32 is configured to shift at least a portion of the fluid flow from one side of the conduit 14 to another side of the conduit 14, thereby providing a different type of fluid movement and mixing contrasting with the double wedge mixing baffles 12. As this disclosure focuses on the double wedge mixing baffles 12, no further detailed explanation of the entry mixing element 30 or the flow shifter element 32 is provided below. However, it will be understood that one or more of the elements defining the mixing component 20 may be reorganized or modified from those shown without departing from the scope of this disclosure (so long as some of the elements in the mixing component 20 are the double wedge mixing baffles 12).

The series of mixing elements and/or baffles defining the mixing component 20 are integrally molded with one another so as to define first and second sidewalls 34, 36. The first and second sidewalls 34, 36 at least partially bound opposite sides of the mixing component 20, whereas the other sides of the mixing component 20 extending between the first and second sidewalls 34, 36 remain largely open or exposed to an associated interior surface 38 of the conduit 14 (one of the interior surfaces 38 is cut away and not shown in FIG. 1). The total number of double wedge mixing baffles 12 and other elements 30, 32 may vary in different embodiments of the mixer 10. Thus, although the particular structure of the double wedge mixing baffles 12 shown in FIG. 1 will be described in considerable detail below, the mixer 10 is merely one example of an embodiment incorporating aspects of the present disclosure.

Figure 2:
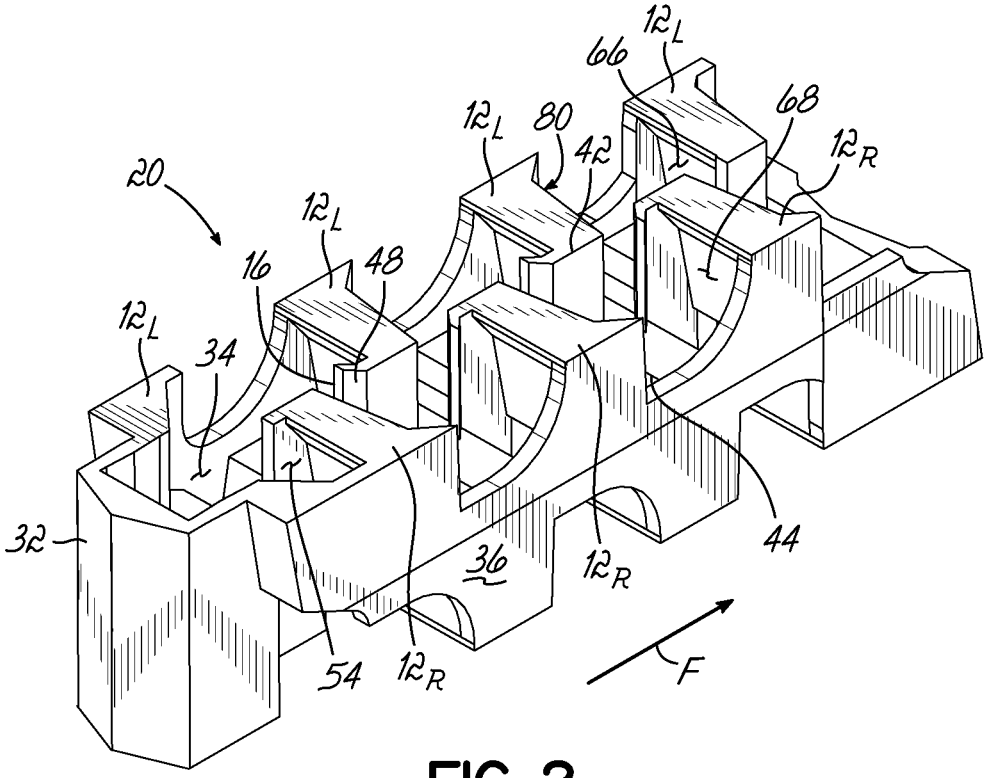
FIG. 2 is a perspective view of a partial portion of the mixing component of FIG. 1 removed from the remainder of the static mixer, the mixing component including alternating right-handed double wedge mixing baffles and left-handed double wedge mixing baffles.

Now referring to FIG. 2, a partial portion of the mixing component 20 is shown in further detail separated from the remainder of the static mixer 10. For example, the specific profile of the first and second sidewalls 34, 36 defined by the opposing sides of the mixing component 20 is more clearly visible. The portion of the mixing component 20 that is shown begins with one of the flow shifter elements 32 and then follows with a series of double wedge mixing baffles 12, which specifically alternate between double wedge mixing baffles $\mathbf{12}_R$ having a first configuration and double wedge mixing baffles $\mathbf{12}_L$ having a second configuration. The first and second configurations are similar, but reversed about at least one center plane aligned parallel to a longitudinal axis of the mixing component 20 and conduit 14 such that the double wedge mixing baffles $\mathbf{12}_R$ and $\mathbf{12}_L$ are mirror images of each other. The baffles 12 having the first configuration are sometimes referred to as right-handed mixing baffles $\mathbf{12}_R$ herein, and the baffles 12 having the second configuration are sometimes referred to as left-handed mixing baffles $\mathbf{12}_L$ herein. This different notation or labeling applied to the two types of double wedge mixing baffles 12 results from the different "rotational" movements that the fluid flow experiences when moving through these mixing baffles 12. As described in detail below, the fluid flow encountering the right-handed mixing baffle $\mathbf{12}_R$ generally moves clockwise about a central axis through the conduit 14, while the fluid flow encountering the left-handed mixing baffle $\mathbf{12}_L$ generally moves counterclockwise about the central axis of the conduit 14. However, this clockwise and counterclockwise movement will be understood to not be a true rotation about the axis, as such a rotation would generally not be helpful in mixing the multiple fluids and avoiding streaking through the static mixer 10.

In view of the similar construction of these double wedge mixing baffles 12, like reference numbers will be used to identify the structure of each of the two types of baffles $\mathbf{12}_R$ and $\mathbf{12}_L$ when described below. Additionally, reference number 12 will continue to be used to generically refer to all of the double wedge mixing baffles 12 (including both right-handed mixing baffles $\mathbf{12}_R$ and left-handed mixing baffles $\mathbf{12}_L$) where appropriate (e.g., the discussion of FIG. 1 above). Consequently, unless otherwise specified, the description of elements of one of the double wedge mixing baffles 12 applies equally to each other double wedge mixing baffle 12 included in the static mixer 10.

Figure 3:
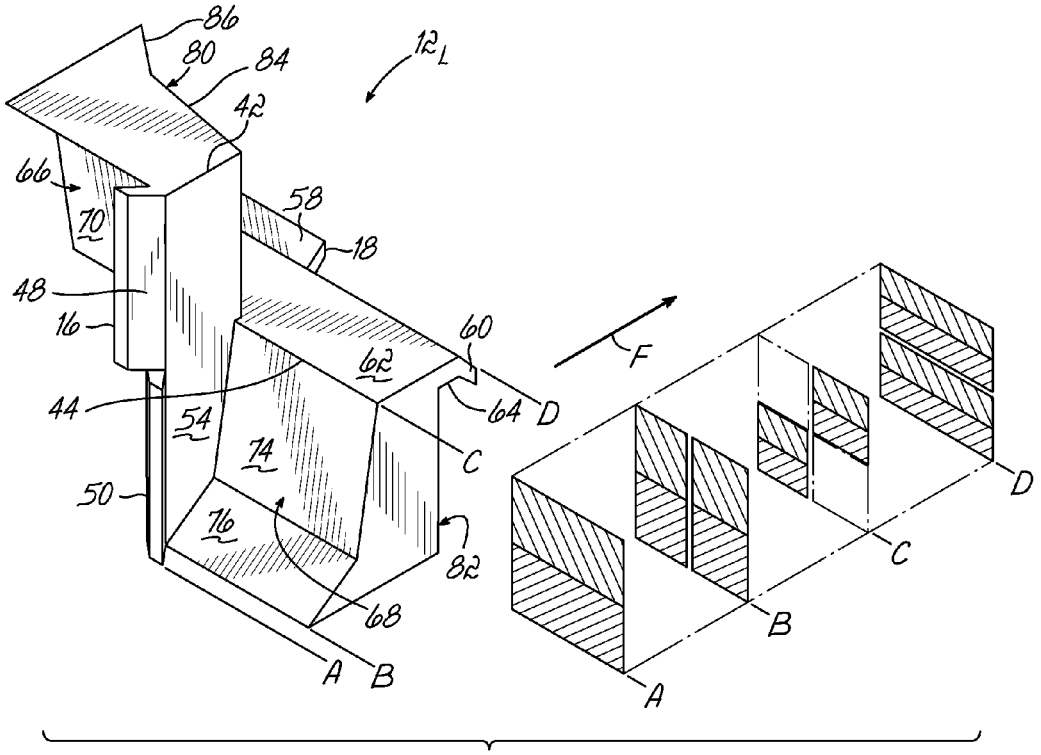
FIG. 3 is a perspective view of one of the left-handed double wedge mixing baffles of FIG. 2, separated from the other elements to reveal specific structural elements, and a schematic view of two fluids flowing through the mixing baffle at various cross-sections thereof.

Turning to FIG. 3, the left-handed mixing baffle $\mathbf{12}_L$ includes a first dividing panel 42 that is generally planar and oriented in a first direction, which is shown as a generally vertical direction in the illustrative embodiment. The left-handed mixing baffle $\mathbf{12}_L$ also includes a second dividing panel 44 that is generally planar and oriented in a second direction, which is shown as a generally horizontal direction in this embodiment. The first dividing panel 42 extends in a direction parallel to a longitudinal axis of the mixing component 20 (e.g., which is also the longitudinal axis of the conduit 14) and terminates in the leading edge 16, which is defined by first and second hook sections 48, 50. The first hook section 48 is slightly angled, or "hooked," toward a left side 52 of the first dividing panel 42, and the second hook section 50 is slightly angled, or "hooked," toward a right side 54 of the first dividing panel 42. The second dividing panel 44 has a shape similar to the first dividing panel 42, but includes the trailing edge 18. To this end, the trailing edge 18 is defined by a first hook section 58 slightly angled toward a top side 62 of the second dividing panel 44 and a second hook section 60 slightly angled toward a bottom side 64 of the second dividing panel 44. The various hook sections 48, 50, 58 and 60 help guide the divided fluid flow (moving along the direction of arrow F in each drawing view) into the opposite sides of the dividing panels 42, 44 while avoiding a division of flow along a long transverse edge which could cause undesirable high amounts of back-pressure in the mixer 10.

It will be appreciated that the orientation-based labels such as vertical, horizontal, left, right, top and bottom as used in reference to surfaces or sides refers to the orientation of these elements as shown in the FIGS., but alternative orientations of these elements within the conduit 14 may be used in actual practice or other embodiments within the scope of this disclosure. To this end, the various sides 52, 54, 62 and 64 of the first and second dividing panels 42, 44 may be referred to as "first" and "second" sides as well, such as in the summary provided above.

Figure 5:
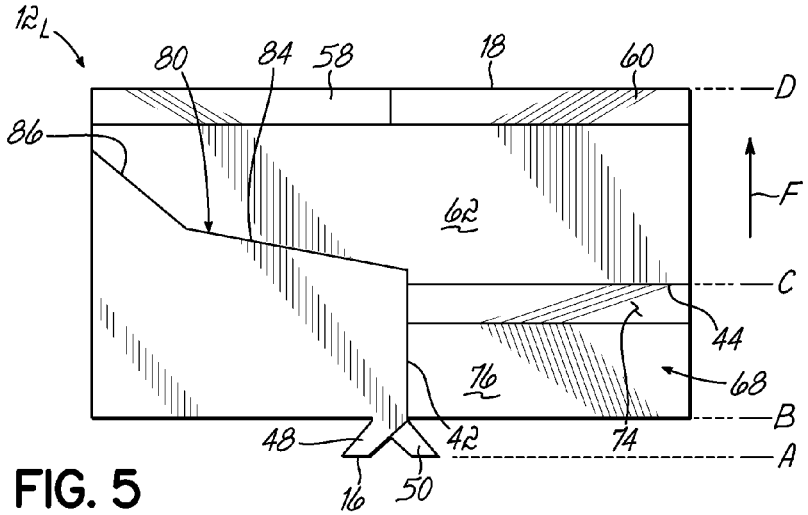
FIG. 5 is a top view of the left-handed mixing baffle of FIG. 3.
Figure 6:
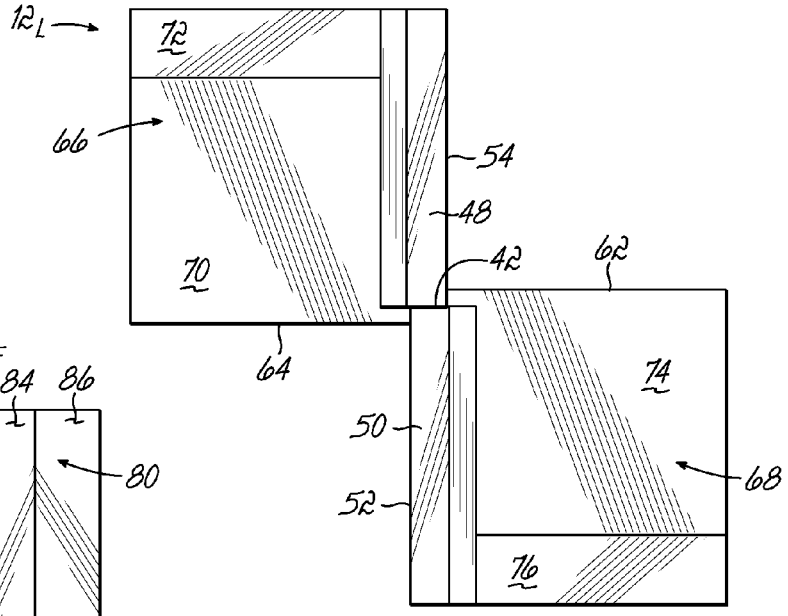
FIG. 6 is a front view of the left-handed mixing baffle of FIG. 3.
Figure 7:
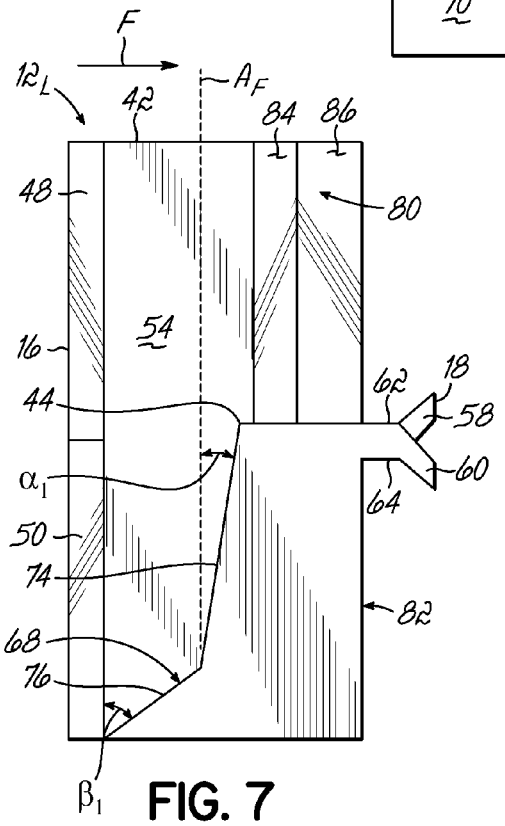
FIG. 7 is a right side view of the left-handed mixing baffle of FIG. 3.

FIG. 3 illustrates the left-handed mixing baffle $\mathbf{12}_L$ of this embodiment generally, but further features of this left-handed mixing baffle $\mathbf{12}_L$ are visible in the top, front, and side views provided in FIGS. 5 through 7, for example. The left-handed mixing baffle $\mathbf{12}_L$ further includes first and second deflecting surfaces 66, 68 projecting or extending outwardly in opposite directions from the first dividing panel 42 towards the first and second sidewalls 34, 36 (when assembled with the remainder of the mixing component 20). Advantageously, each of the first and second deflecting surfaces 66, 68 includes multiple planar surfaces (also referred to as "wedge surfaces") oriented at different angles relative to the fluid flow through the mixing baffle $\mathbf{12}_L$. For example, the first deflecting surface 66 on the left side 52 of the first dividing panel 42 includes a first planar surface 70 extending adjacent the center of the first dividing panel 42 and a second planar surface 72 located above the first planar surface 70, the second planar surface 72 being oriented at a sharper angle to the fluid flow than the first planar surface 70. Likewise, the second deflecting surface 68 on the right side 54 of the first dividing panel 42 includes a first planar surface 74 extending adjacent the center of the first dividing panel 42 and a second planar surface 76 located below the first planar surface 74, the second planar surface 76 being oriented at a sharper angle to the fluid flow than the first planar surface 74. The arrangement of two planar surfaces 70, 72, 74, and 76 on each of the first and second deflecting surfaces 66, 68 enables the left-handed mixing baffle $\mathbf{12}_L$ of this embodiment to provide optimized mixing and reduced waste volume retention compared to conventional mixing baffle designs in which each deflecting surface includes only a single planar surface or rounded surfaces.

The fluid flowing through the left-handed mixing baffle $\mathbf{12}_L$ is directed by these various surfaces as follows. One simplified schematic of two fluids moving through the left-handed mixing baffle $\mathbf{12}_L$ at various cross sections thereof (A through D) is shown in FIG. 3 as well, to help clarify the following description of the flow. The fluid flow is schematically shown before it encounters the leading edge 16 at cross section A. First, this fluid flow encountering the mixing baffle $\mathbf{12}_L$ is divided by the first dividing panel 42 into relatively equal flows on the left side 52 and on the right side 54 of the first dividing panel 42, as shown at cross section B. The first deflecting surface 66 is configured to direct fluid that is flowing on the left side 52 of the first dividing panel 42 downwardly toward the lower left quadrant of the mixing baffle $\mathbf{12}_L$ (as shown in the front view of FIG. 6), so that this fluid travels toward the space adjacent the bottom side 64 of the second dividing panel 44. To this end, the fluid flow at the top of the left side 52 of the first dividing panel 42 is first deflected downwardly by the second planar surface 72, and then the fluid flow continues to follow along the first planar surface 70 during continued deflection towards the lower left quadrant of the mixing baffle $\mathbf{12}_L$. The "compressed" flow is shown schematically in the cross section C, which is at the longitudinal center of the mixing baffle $\mathbf{12}_L$ and where the first dividing panel 42 connects to the second dividing panel 44.

The flow on the opposite side of the mixing baffle $\mathbf{12}_L$ is similarly diverted using the mirror image structure defined by the second deflecting surface 68 adjacent the right side 54 of the first dividing panel 42. In this regard, the second deflecting surface 68 is configured to direct fluid that is flowing on the right side 54 of the first dividing panel 42 upwardly toward the upper right quadrant of the mixing baffle $\mathbf{12}_L$ (as shown in the front view of FIG. 6), so that this fluid travels toward the space adjacent the top side 62 of the second dividing panel 44. To this end, the fluid flow at the bottom of the right side 54 of the first dividing panel 42 is first deflected upwardly by the second planar surface 76, and then the fluid flow continues to follow along the first planar surface 74 during continued deflection towards the upper right quadrant of the mixing baffle $\mathbf{12}_L$. The "compressed" flow is shown schematically in the cross section C, which is at the longitudinal center of the mixing baffle $\mathbf{12}_L$. Thus, the first half (along a longitudinal or flow direction) of the left-handed mixing baffle 12L effectively divides the fluid flow and then shifts each divided portion of the fluid flow in opposite directions to opposing quadrants of the conduit 14 when the mixer 10 is in use in this embodiment.

After being shifted or compressed towards the lower left and upper right quadrants, the fluid flow begins to expand laterally to fill substantially all of the space in the conduit 14 once again. To enable this flow expansion, the back half (in a longitudinal or flow direction) of the left-handed mixing baffle $\mathbf{12}_L$ includes similar structures as those described above for the front half. More particularly, the left-handed mixing baffle $\mathbf{12}_L$ further includes third and fourth deflecting surfaces 80, 82 projecting or extending outwardly in opposite directions from the second dividing panel 44 towards the top and bottom of the conduit 14 (when located in the mixer 10). Advantageously, each of the third and fourth deflecting surfaces 80, 82 includes multiple planar "wedge surfaces" oriented at different angles relative to the fluid flow, just like the first and second deflecting surfaces 66, 68 described above. Indeed, each of the wedge surfaces mirror one another in this embodiment to make the mixing baffle $\mathbf{12}_L$ largely symmetrical. The third deflecting surface 80 on the top side 62 of the second dividing panel 44 includes a first planar surface 84 extending adjacent the center of the second dividing panel 44 and a second planar surface 86 located to the left of the first planar surface 84, the second planar surface 86 being oriented at a sharper angle to the fluid flow than the first planar surface 84. Likewise, the fourth deflecting surface 82 on the bottom side 64 of the second dividing panel 44 includes a first planar surface 88 extending adjacent the center of the second dividing panel 44 and a second planar surface 90 located to the right of the first planar surface 88, the second planar surface 90 being oriented at a sharper angle to the fluid flow than the first planar surface 88 (it will be noted that the fourth deflecting surface 82 cannot be seen in detail in the FIGS. 3 and 5-7 views, but the corresponding mirror image is shown in the right-handed mixing baffle $\mathbf{12}_R$ shown in FIG. 4, for example). It will be understood that the first and third deflecting surfaces 66, 80 are formed on opposing faces (looking upstream and downstream) of the left-handed mixing baffle $\mathbf{12}_L$, specifically in an upper left quadrant of this mixing baffle $\mathbf{12}_L$. Likewise, the second and fourth deflecting surfaces 68, 82 are formed on opposing faces (looking upstream and downstream) of the left-handed mixing baffle $\mathbf{12}_L$, specifically in a lower right quadrant of this mixing baffle $\mathbf{12}_L$. The first and second dividing panels 42, 44 and the deflecting surfaces 66, 68, 80 and 82 are integrally formed as a unitary member, such as by injection molding a plastic material, as understood in the mixer art.

Thus, the expansion of the fluid flow above and below the second dividing panel 44 occurs in a similar manner as the flow shifting or contraction next to the first dividing panel 42, but just in reverse. The fluid flow that has been shifted into the upper right quadrant begins to flow along the first planar surface 84 of the third deflecting surface 80 and then the second planar surface 86 of the third deflecting surface 80. This movement causes the flow to shift or expand to fill substantially an entire upper portion of the conduit 14 defined above the top side 62 of the second dividing panel 44. In a similar manner, the fluid flow that has been shifted into the lower left quadrant begins to flow along the first planar surface 88 of the fourth deflecting surface 82 and then along the second planar surface 90 of the fourth deflecting surface 82. This movement causes the flow to shift or expand to fill substantially the entire lower portion of the conduit 14 defined below the bottom side 64 of the second dividing panel 44. The divided flows are then ready to be "recombined" at the trailing edge 18 defined by the first and second hook sections 58, 60 of the second dividing panel 44. This "recombination" is generally not a complete recombination because the fluid flow moving past the trailing edge 18 of the left-handed mixing baffle $\mathbf{12}_L$ is generally already flowing past a leading edge 16 on another mixing element that further divides the fluid flow in a different direction (e.g., such as a right-handed mixing baffle $\mathbf{12}_R$).

As schematically shown in cross section D in FIG. 3, this shifting and dividing movement of the fluid flow caused by flow around the left-handed mixing baffle $\mathbf{12}_L$ is capable of doubling the number of layers of two fluids originally presented in layers before entry at the leading edge 16 of the mixing baffle $\mathbf{12}_L$. Of course, it will be understood that the actual flow is likely more mixed together (e.g., the mixing is optimized) as a result of flowing over the differently-angled surfaces on the first, second, third and fourth deflecting surfaces 66, 68, 80 and 82 and as a result of flowing over the various hook sections 48, 50, 58 and 60. In any event, the flow of two or more fluids making up the fluid flow are mixed by flowing through the mixing baffles 12 when inserted into the conduit 14 of the static mixer 10.

As described above, the first planar surfaces 70, 74, 84 and 88 are oriented at a different angle to the flow than the second planar surfaces 72, 76, 86 and 90. The exemplary angles defined by these surfaces in this embodiment of the left-handed mixing baffle $\mathbf{12}_L$ are shown in FIG. 7, for example, as they are applied to the second deflecting surface 68. It will be understood that these exemplary angles are measured from a plane perpendicular to the fluid flow direction through the conduit 14, one of these perpendicular planes $A_F$ being shown in phantom in FIG. 7 for clarity, and it will also be understood that the exemplary angles apply equally for the other deflecting surfaces on the mixing baffle $\mathbf{12}_L$. The first planar surface 74 defines a first angle $\alpha_1$ with the perpendicular plane $A_F$, this first angle $\alpha_1$ being about 10° in this embodiment. The second planar surface 76 defines a second angle $\beta_1$ with the perpendicular plane $A_F$, this second angle $\beta_1$ being about 55° in this embodiment. Accordingly, the first and second planar surfaces 74, 76 are angled from one another by about 45°, thereby changing how the fluid flow expands or contracts as it shifts during movement through the mixing baffles $\mathbf{12}_L$. Furthermore, the first and second planar surfaces 74, 76 collectively define a double wedge shape for the deflecting surfaces 66,68, 80 and 82.

More particularly, the sharper angling of the second planar surfaces 72, 76, 86 and 90 produces multiple beneficial advantages when mixing fluid flows in the static mixer 10. To this end, the "double wedge" at each of the deflecting surfaces 66, 68, 80 and 82 effectively shortens the distance within the conduit 14 that the expanding or contracting fluid has to cross while flowing through the mixing baffles 12. The fluid flow therefore transitions easily between the contracting and expanding portions in the series of mixing baffles 12 contained within the mixing component 20. The fluid mixing itself is also optimized because the differing angles at the deflecting surfaces 66, 68, 80 and 82 further manipulate the flow characteristics adjacent these locations, which enhances the mixing of two of more fluids during the movement through the mixing baffles 12 (e.g., the two fluids mix together by a small degree more than what the general schematic indication shows in FIG. 3 at the various cross sections).

The sharper angling at the second planar surfaces 72, 76, 86 and 90 also causes the underlying wedge-like structure at the upper left quadrant and the lower right quadrant of the left-handed mixing baffle $12_L$ to fill more volume within the conduit 14, thereby advantageously reducing the retained waste volume within the conduit 14 when the static mixer 10 stops being used. The increase in backpressure caused by flowing over these sharper angled second planar surfaces 72, 76, 86 and 90 is minimized by only providing the sharper angling over these small portions of the corresponding deflecting surfaces 66, 68, 80 and 82. Therefore, the decrease in retained volume enables what can be a substantial cost savings on wasted material in certain dispensing fields, without a significant increase in the backpressure or necessary length of the mixing component 20 in the static mixer 10. It will be appreciated that any combination of one or more of the deflecting surfaces 66, 68, 80 and 82 may be provided with the double wedge arrangement in other embodiments of the mixing baffles 12 to achieve these benefits, although the benefits are most pronounced when each of the deflecting surfaces 66, 68, 80 and 82 have the double wedge arrangement.

Figure 4:
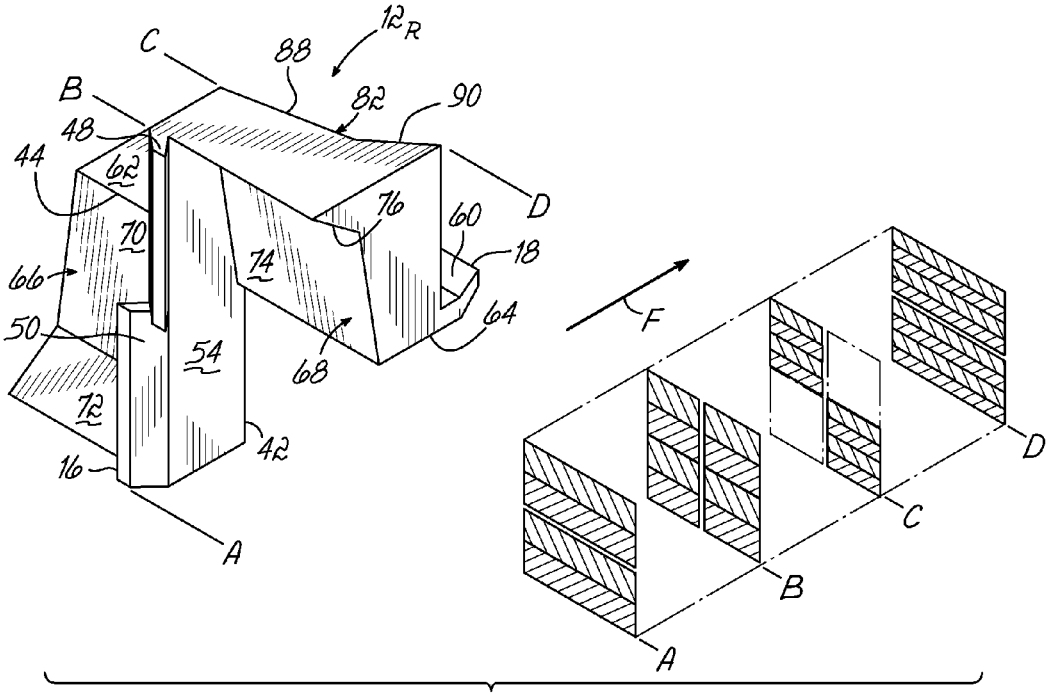
FIG. 4 is a perspective view of one of the right-handed double wedge mixing baffles of FIG. 2, separated from the other elements to reveal specific structural elements, and a schematic view of two fluids flowing through the mixing baffle at various cross-sections thereof (following up from the flow shown in FIG. 3).
Figure 8:
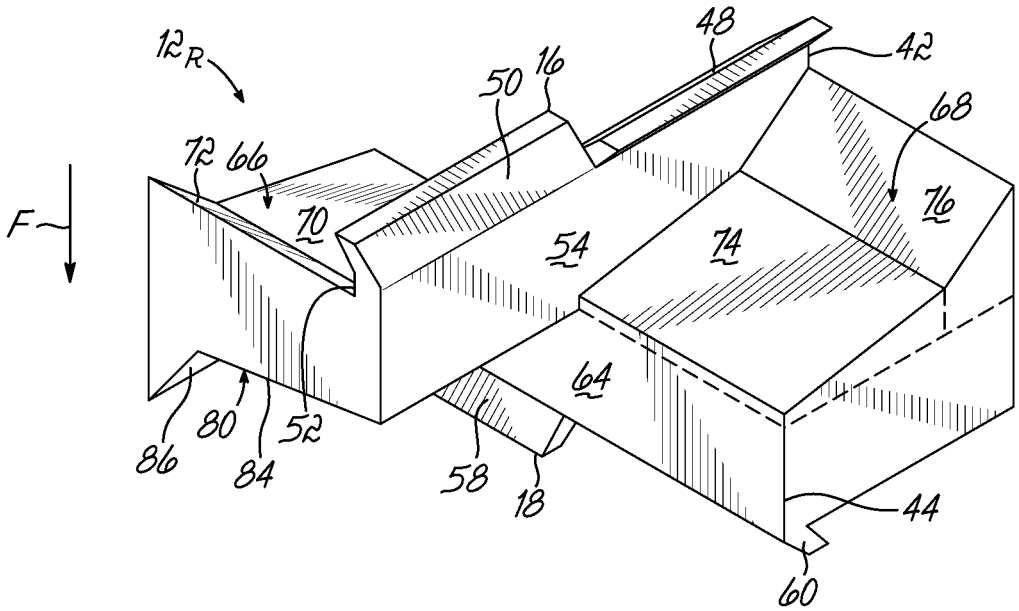
FIG. 8 is a bottom front perspective view of the right-handed double wedge mixing baffle of FIG. 4, this view being used for comparison purposes to two embodiments described below.

As briefly described above, the right-handed mixing baffle $12_R$ shown in FIGS. 4 and 8 includes essentially the same identical structure as the left-handed mixing baffle $12_L$ described in detail above, but just with the deflecting surfaces 66, 68, 80, 82 being oriented to be a mirror image of those in the left-handed mixing baffle $12_L$. The panels and surfaces of the right-handed mixing baffle $12_R$ are substantially identical in structure and function to the corresponding panels and surfaces described above, so these elements have been labeled with the same reference numbers on both types of mixing baffles 12, $12_L$, $12_R$. The sole difference caused by orienting the deflecting surfaces in a mirror image is that the flow on the left side 52 of the first dividing panel 42 is shifted by the first and fourth deflecting surfaces 66, 82 to the upper left quadrant (when viewed from the front) before extending across the top side 62 of the second dividing panel 44, while the flow on the right side 54 of the first dividing panel 42 is shifted by the second and third deflecting surfaces 68, 80 to the lower right quadrant before extending across the bottom side 64 of the second dividing panel 44. Once again, one simplified schematic of two fluids moving through the right-handed mixing baffle $12_R$ at various cross sections thereof (A through D) is shown in FIG. 4, to help clarify the flow (this follows up on the flow shown in FIG. 3, so as to show the further division of layers in the schematic flow). Thus, the left-handed mixing baffles $12_L$ shift fluid flow in a generally counterclockwise direction, while the right-handed mixing baffles $12_R$ shift flow in a generally clockwise direction. It will be appreciated that by alternating these mixing baffles $12_L$, $12_R$ in the series within the mixing component 20, better mix quality overall is achieved by the static mixer 10 with fewer overall mixing elements/baffles (and a corresponding smaller overall length of the mixing component 20).

In the exemplary embodiment, the series of mixing baffles 12 is molded together in series to form a unitary version of the mixing component 20, with the sidewalls 34, 36 as shown in FIG. 2. However, these mixing baffles 12 (and the other mixing elements interspersed in the series of the mixing component 20) may be separately formed and coupled together in the desired order after manufacturing, in other embodiments. The mixing baffles 12 may be pushed together and held together by a locking fit in other embodiments as well, including, for example, the alternative embodiments with notches as described in connection with FIGS. 9 and 10 below.

It will further be understood that the exemplary angles and/or relative lengths/sizes defined by the various wedge surfaces may be modified in other embodiments of the mixing baffles 12 consistent with the scope of this disclosure. In one example, the first and second deflecting surfaces 66, 68 along the entry to the mixing baffles 12 may be oriented at a slightly different angle than the third and fourth deflecting surfaces 80, 82 along the exit to the mixing baffles 12. More specifically, one example of this would be to have the first planar surfaces 70, 74 of the first and second deflecting surfaces 66, 68 be located at a first angle relative to fluid flow of $\alpha_1$=12°, while the first planar surfaces 84, 88 of the third and fourth deflecting surfaces 80, 82 are located at a first angle relative to fluid flow of $\alpha_1$=10°. Such an alternative arrangement provides favorable flow characteristics specifically tailored for entry into and exit out of the mixing baffles 12. Furthermore, the angle $\alpha_1$ of these first planar surfaces 70, 74, 84 and 88 could be modified to be within the range of 5° to 15° in other embodiments based on the specific needs of the end user, without departing from the scope of the disclosure. Likewise, the relative angle between the angle $\alpha_1$ of these first planar surfaces 70, 74, 84 and 88 and the angle $\beta_1$ of the corresponding second planar surfaces 72, 76, 86 and 90 may be modified to be in the range of 25° to 50° in other embodiments of the mixing baffles. Therefore, taking these potential ranges into account, the angle $\beta_1$ of the corresponding second planar surfaces 72, 76, 86 and 90 may be as low as 30° or as high as 65° in these various alternatives. The advantages described in detail above continue to be present within these exemplary ranges, so long as some, if not all, of the deflecting surfaces 66, 68, 80 and 82 continues to include two "wedges," e.g., two planar surfaces.

In yet another alternative embodiment not shown in the drawings, the angle $\alpha_1$ of these first planar surfaces 70, 74, 84 and 88 could be modified to be 0° (from a plane perpendicular to the flow direction), or in other words, generally perpendicular to the flow direction. Instead of a double wedge shape, a portion of the first, second, third and fourth deflecting surfaces 66, 68, 80 and 82 would be generally plate-like, while another portion would be generally wedge-like. While such an embodiment continues to achieve the flow optimization benefits described above, the double wedge configuration of previously described embodiments further reduces retained volume and waste within the static mixer 10 when discharging of mixed fluid is completed.

Figure 9:
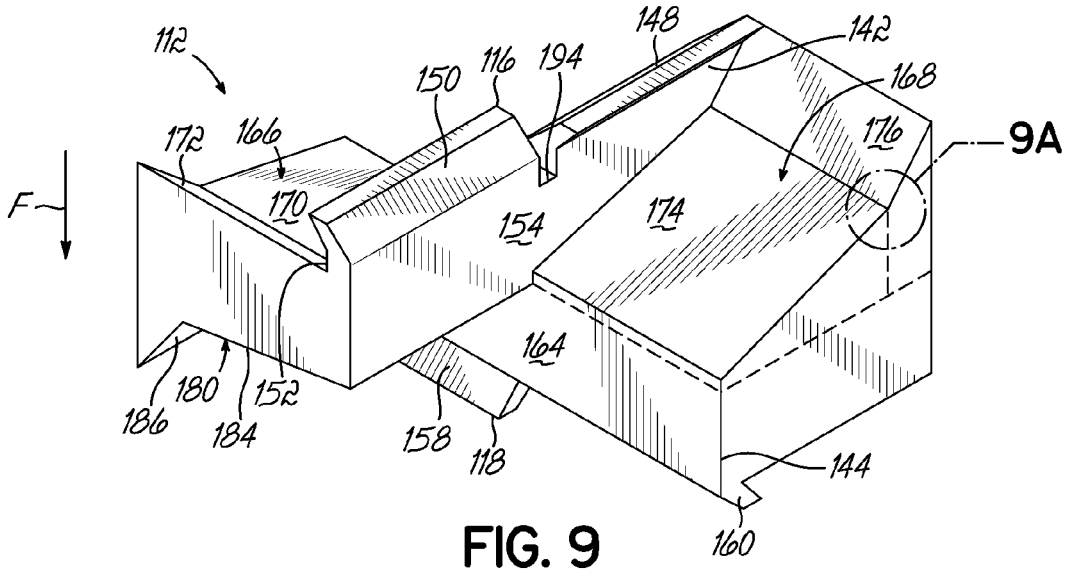
FIG. 9 is a bottom front perspective view of a right-handed double wedge mixing baffle according to another embodiment of the invention, this version of the mixing baffle having angled deflecting surfaces with larger angles of incidence to the flow than the angled deflecting surfaces included with the double wedge mixing baffle of FIG. 8.
Figure 10:
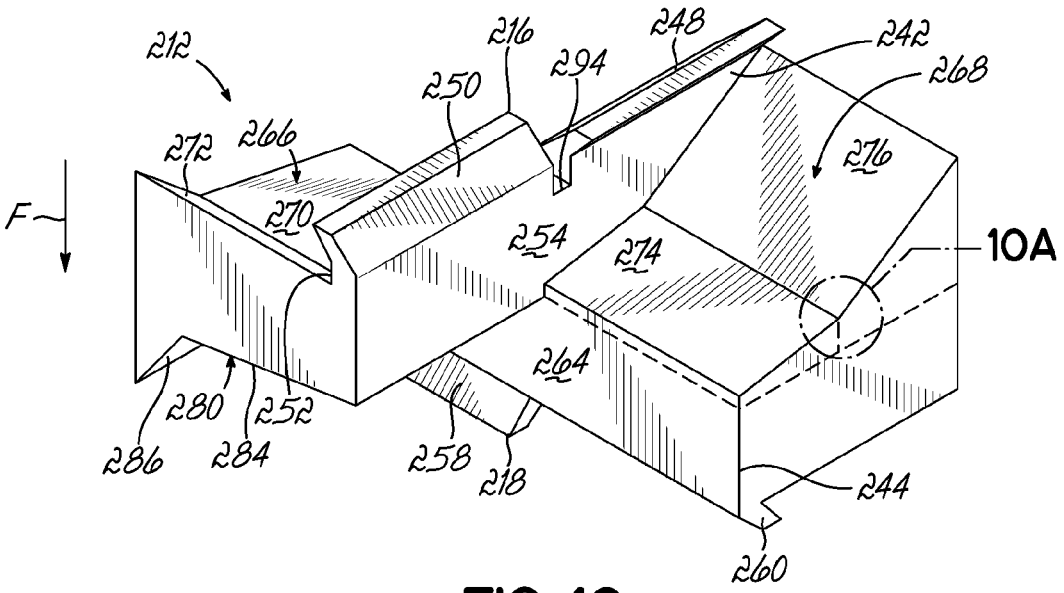
FIG. 10 is a bottom front perspective view of a right-handed double wedge mixing baffle according to a further embodiment of the invention, this version of the mixing baffle having angled deflecting surfaces with different relative portion lengths than the angled deflecting surfaces included with the double wedge mixing baffle of FIG. 8.

With reference to FIGS. 9 and 10 two alternative embodiments of the right-handed mixing baffle are shown. These alternative embodiments are shown in the same orientation as the right-handed mixing baffle $12_R$ shown in FIG. 8, to thereby clarify the distinctions between the embodiments. It will be appreciated that similar variations can be applied to the left-handed mixing baffles within the scope of the present disclosure.

Figure 9A:
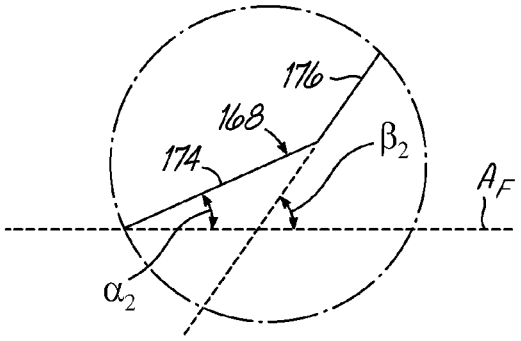
FIG. 9A is a spot detail side view of one of the angled deflecting surfaces of the mixing baffle of FIG. 9, so as to show the angle of incidence of first and second planar surfaces of the angled deflecting surface relative to the fluid flow.

Turning first to FIG. 9, the double wedge mixing baffle 112 of this embodiment includes substantially all of the same panels and surfaces as the first embodiment of the mixing baffle 12, and these elements are provided with similar reference numbers in the 100 series without further explanation below except for the differences in this embodiment (e.g., the second deflecting surface 168 corresponds to the second deflecting surface 68 described above, albeit with slight differences). As shown most clearly in the perspective view of FIG. 9, the angles of the first planar surfaces 170, 174, 184 and 188 and the angles of the second planar surfaces 172, 176, 186 and 190 are larger with respect to the fluid flow than the corresponding 10° and 55° angles of these elements in the first embodiment described above. To this end, and as shown in the detail view of FIG. 9A, the first planar surfaces 170, 174, 184 and 188 define a first angle $\alpha_2$ with respect to a plane $A_F$ perpendicular to the flow direction of about 21°. The second planar surfaces 172, 176, 186 and 190 define a second angle $\beta_2$ with respect to a plane $A_F$ perpendicular to the flow direction of about 66°. Thus, as with the first embodiment shown, the surfaces are located at an angle of about 45° from one another. As will be readily understood, the version of the double wedge mixing baffle 112 in this embodiment shifts the fluid flow more rapidly during contraction and expansion, and the double wedge mixing baffle 112 of this embodiment takes up even more volume in the mixer 10 so as to further limit retained waste volume at the end of a mixing and dispensing cycle. Of course, the backpressure generated in the fluid flow may increase over the previous embodiment, so a balance of the benefits and drawbacks must be weighed when designing a specific double wedge mixing baffle 12 for different technical fields needing a static mixer 10 according to the current invention.

The double wedge mixing baffle 112 of this embodiment also includes a notch 194 cut into the middle of the first dividing panel 142. A similar notch (not shown) may be cut into the middle of the second dividing panel 144 as well, these notches 194 configured to engage with corresponding notches 194 on other double wedge mixing baffles 112 used in series in the static mixer 10. The notch 194 enables the first dividing panel 142 at a leading edge 116 of one double wedge mixing baffle 112 to engage partially with the second dividing panel 144 at a trailing edge 118 of another double wedge mixing baffle 112, thereby saving open space within the conduit 14 of the mixer 10 that could retain additional wasted material when use of the mixer 10 is completed. Likewise, as discussed above, the division of the flow by the downstream double wedge mixing baffle 112 occurs before or simultaneous with the rejoining of the divided flow in the upstream double wedge mixing baffle 112, thereby enhancing mixing efficiency. It will be understood that these notches 194 may be omitted or revised in location and size in other embodiments consistent with this disclosure.

Figure 10A:
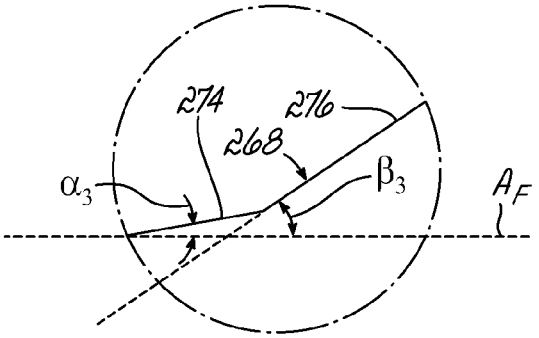
FIG. 10A is a spot detail side view of one of the angled deflecting surfaces of the mixing baffle of FIG. 10, so as to show the angle of incidence of first and second planar surfaces of the angled deflecting surface relative to the fluid flow.

Now with reference to FIG. 10, the double wedge mixing baffle 212 of this embodiment includes substantially all of the same panels and surfaces as the first embodiments of the mixing baffles 12, 112, and these elements are provided with similar reference numbers in the 200 series without further explanation below except for the differences in this embodiment (e.g., the second deflecting surface 268 corresponds to the second deflecting surface 68 described above, albeit with slight differences; and the notch 294 corresponds to the notch 194 of the previously described embodiment). As shown most clearly in the perspective view of FIG. 10, the angles of the first planar surfaces 270, 274, 284 and 288 and the angles of the second planar surfaces 272, 276, 286 and 290 are back to the same as in the first embodiment described above. To this end, and as shown in the detail view of FIG. 10A, the first planar surfaces 270, 274, 284 and 288 define a first angle $\alpha_3$ with respect to a plane $A_F$ perpendicular to the flow direction of about 10°. The second planar surfaces 272, 276, 286 and 290 define a second angle $\beta_3$ with respect to a plane $A_F$ perpendicular to the flow direction of about 55°. However, the relative lengths of the first and second planar surfaces have been modified such that the second planar surfaces 272, 276, 286 and 290 define a larger portion of the corresponding first, second, third and fourth deflecting surfaces 266, 268, 280 and 282. As with the revision in the embodiment shown in FIG. 9, such an alternative double wedge mixing baffle 212 may achieve faster flow shifting and less retained volume in the conduit 14, but with a corresponding increase in the backpressure generated in the fluid flow when moving through the static mixer 10. Accordingly, it will be understood that the specific angles and relative sizes or lengths of the surface portions may be modified in other embodiments consistent with the scope of this disclosure.

In each embodiment of the double wedge mixing baffles according to this disclosure, at least some, if not all, of the various deflecting surfaces advantageously include multiple "wedges" or multiple planar surfaces with some of these surfaces being more sharply angled relative to the fluid flow direction than others. This sharper angling over a part of the deflecting surfaces reduces the distance that the fluid flow has to cross during the contraction, shifting, and expansion movements experienced during flow through the double wedge mixing baffles. This arrangement leads to more optimized mixing and less retained waste volume at the end of a cycle without significant increases in mixer length or backpressure. Consequently, the double wedge mixing baffles of this disclosure address many of the areas requiring improvement or optimization in conventional mixing and flow shifting elements used in a static mixer.

While the present invention has been illustrated by a description of exemplary embodiments and while these embodiments have been described in some detail, it is not the intention of the Applicant to restrict or in any way limit the scope of the appended claims to such detail. Additional advantages and modifications will readily appear to those skilled in the art. The various features of the disclosure may be used alone or in any combination depending on the needs and preferences of the user. This has been a description of the present invention, along with the preferred methods of practicing the present invention as currently known. However, the invention itself should only be defined by the appended claims.

The invention claimed is:

1. A mixing baffle for mixing a fluid flow having at least two components, the mixing baffle comprising:

a first dividing panel including a first side and a second side, said first dividing panel defining a leading edge;

a first deflecting surface projecting from said first side of said first dividing panel so as to occlude at least part of a path for fluid flow along said first side of said first dividing panel;

a second deflecting surface projecting from said second side of said first dividing panel so as to occlude at least part of a path for fluid flow along said second side of said first dividing panel;

a second dividing panel connected to said first dividing panel and oriented transverse to said first dividing panel, said second dividing panel defining a trailing edge and including a first side and a second side;

a third deflecting surface projecting from said first side of said second dividing panel proximate to said first deflecting surface; and a fourth deflecting surface projecting from said second side of said second dividing panel proximate to said second deflecting surface, at least one of said first, second, third and fourth deflecting surfaces being defined by a first planar surface and a second planar surface oriented at an angle from said first planar surface such that said first and second planar surfaces are arranged at different angles relative to the fluid flow, the fluid flow being divided at said leading edge by said first dividing panel into a first flow portion, which is shifted by said first and fourth deflecting surfaces from said first side of said first dividing panel to said second side of said second dividing panel, and a second flow portion, which is shifted by said second and third deflecting surfaces from said second side of said first dividing panel to said first side of said second dividing panel, and the first and second flow portions being recombined at said trailing edge.

2. The mixing baffle of claim 1, wherein each of said first, second, third and fourth deflecting surfaces is defined by a first planar surface and a second planar surface oriented at an angle from said first planar surface, such that said first and second planar surfaces are arranged at different angles relative to the fluid flow.

3. The mixing baffle of claim 2, wherein:

said first dividing panel includes first and second hook sections bent in opposite directions towards corresponding said first and second sides of said first dividing panel at said leading edge, and said second dividing panel includes first and second hook sections bent in opposite directions towards corresponding said first and second sides of said second dividing panel at said trailing edge.

4. The mixing baffle of claim 2, wherein each said second planar surface is angled from an adjacent said first planar surface by an angle ranging between 25° and 50°.

5. The mixing baffle of claim 2, wherein each said first planar surface is angled from a plane perpendicular to the fluid flow by a non-zero angle such that each of the first, second, third and fourth deflecting surfaces defines a double wedge shape.

6. The mixing baffle of claim 5, wherein each of said first planar surface is angled from a plane perpendicular to the fluid flow by an angle ranging between 5° and 15°.

7. The mixing baffle of claim 5, wherein:

said first planar surfaces of said first and second deflecting surfaces are angled from the plane perpendicular to the fluid flow by a first angle, and said first planar surfaces of said third and fourth deflecting surfaces are angled from the plane perpendicular to the fluid flow by a second angle different than the first angle.

8. The mixing baffle of claim 7, wherein said first angle is larger than said second angle.

9. The mixing baffle of claim 2, wherein said first dividing panel is oriented generally perpendicular to said second dividing panel such that when the mixing baffle is located within a conduit containing the fluid flow, said first dividing panel is oriented generally vertically in the conduit while said second dividing panel is oriented generally horizontally in the conduit.

10. The mixing baffle of claim 9, wherein:

said first and fourth deflecting surfaces shift the first flow portion to contract downwardly along said first dividing panel before expanding to the right along said second dividing panel, and said second and third deflecting surfaces shift the second flow portion to contract upwardly along said first dividing panel before expanding to the left along said second dividing panel, thereby effectively shifting the first and second flow portions in a counterclockwise direction.

11. The mixing baffle of claim 9, wherein said first and fourth deflecting surfaces shift the first flow portion to contract upwardly along said first dividing panel before expanding to the right along said second dividing panel, and said second and third deflecting surfaces shift the second flow portion to contract downwardly along said first dividing panel before expanding to the left along said second dividing panel, thereby effectively shifting the first and second flow portions in a clockwise direction.

12. The mixing baffle of claim 2, wherein said first and second dividing panels and said first, second, third and fourth deflecting surfaces are integrally formed as a unitary piece by injection molding.

13. A static mixer for mixing a fluid flow having at least two components, the static mixer comprising:

a mixer conduit configured to receive the fluid flow; and a mixing component defined by a plurality of mixing elements positioned in said mixer conduit, said plurality of mixing elements including at least one mixing baffle according to claim 1.

14. The static mixer of claim 13, wherein each of said first, second, third and fourth deflecting surfaces of said mixing baffles is defined by a first planar surface and a second planar surface oriented at an angle from said first planar surface such that said first and second planar surfaces are arranged at different angles relative to the fluid flow.

15. The static mixer of claim 14, wherein said plurality of mixing baffles include left-handed mixing baffles that shift the fluid flow in a counterclockwise direction and right-handed mixing baffles that shift the fluid flow in a clockwise direction, and said mixing component includes an alternating series of said left-handed mixing baffles and said right-handed mixing baffles.

16. The static mixer of claim 15, wherein said plurality of mixing elements further include at least one different type of flow shifting element interspersed with said alternating series of said left-handed mixing baffles and said right-handed mixing baffles.

17. The static mixer of claim 14, wherein said mixing component is integrally formed as a unitary piece by injection molding, said plurality of mixing elements collectively defining first and second opposed sidewalls of said unitary piece, with said sidewalls extending along a length of said mixer conduit.

18. The static mixer of claim 14, wherein each said first planar surface is angled from a plane perpendicular to the fluid flow by a non-zero angle such that each of the first, second, third and fourth deflecting surfaces defines a double wedge shape.

19. The static mixer of claim 14, wherein said first dividing panel is oriented generally perpendicular to said second dividing panel such that said first dividing panel is oriented generally vertically in the mixer conduit while said second dividing panel is oriented generally horizontally in the mixer conduit.

20. A method of mixing at least two components of a fluid flow with a static mixer including a mixer conduit and a plurality of the mixing baffle according to claim 1, the method comprising:

introducing the fluid flow having at least two components into an inlet end of the mixer conduit;

forcing the fluid flow through the plurality of mixing baffles to produce a mixed fluid flow, wherein the forcing further includes:

dividing the fluid flow with the leading edge of the first dividing panel into a first flow portion located along a first side of the first dividing panel and a second flow portion located along a second side of the first dividing panel;

shifting the first flow portion with the first and fourth deflecting surfaces from the first side of the first dividing panel to a second side of the second dividing panel;

shifting the second flow portion with the second and third deflecting surfaces from the second side of the first dividing panel to a first side of the second dividing panel; and recombining the first and second flow portions at the trailing edge of the second dividing panel; and discharging the mixed fluid flow from an outlet end of the mixer conduit after the fluid flow is forced through the plurality of mixing baffles, a surface on at least one of the first, second, third and fourth deflecting surfaces shortening a distance that the first or second flow portion needs to travel during shifting along the corresponding at least one of the first, second, third and fourth deflecting surfaces.

21. The method of claim 20, wherein each of the first, second, third and fourth deflecting surfaces being defined by a first planar surface and a second planar surface oriented at an angle relative to the first planar surface, such that the first and second flow portions travel along a shorter distance during shifting by the first, second, third and fourth deflecting surfaces.

22. The method of claim 21, wherein the fluid flow including a plurality of alternating layers of the at least two components, and forcing of the fluid flow through the plurality of mixing baffles further comprises:

doubling a number of the alternating layers of the at least two components between the leading edge and trailing edge of each mixing baffle.

23. The method of claim 21, wherein each of the first and second planar surfaces is angled at a non-zero angle relative to a plane perpendicular to the fluid flow through the static mixer such that each of the first, second, third and fourth deflecting surfaces defines a double wedge shape, and the method further comprises:

disconnecting the inlet end of the static mixer from a source of the fluid flow when discharging of the mixed fluid flow is completed; and minimizing fluid flow waste defined by retained volume within the static mixer as a result of the double wedge shape for each of the first, second, third and fourth deflecting surfaces on the mixing baffle.

24. The method of claim 23, wherein:

the first planar surfaces of the first and second deflecting surfaces is angled from the plane perpendicular to the fluid flow at a first angle, and the first planar surfaces of the third and fourth deflecting surfaces is angled from the plane perpendicular to the fluid flow at a second angle which is different than the first angle, thereby shifting the fluid flow differently adjacent an entry at the first dividing panel compared to adjacent an exit at the second dividing panel.

25. The method of claim 21, wherein the plurality of mixing baffles includes left-handed mixing baffles and right-handed mixing baffles, and forcing through the plurality of mixing baffles further comprises:

shifting the first and second flow portions in a counter-clockwise direction with the left-handed mixing baffles; and shifting the first and second flow portions in a clockwise direction with the right-handed mixing baffles.

* * * * *